US008289253B2

(12) United States Patent
Lee et al.

(10) Patent No.: US 8,289,253 B2
(45) Date of Patent: Oct. 16, 2012

(54) METHOD OF DRIVING DISPLAY DEVICE TO CONTROL OVER-CURRENT, CIRCUIT OF DRIVING DISPLAY DEVICE USING THE METHOD AND DISPLAY DEVICE HAVING THE SAME

(75) Inventors: Baek-Woon Lee, Yongin-si (KR); Kyong-Tae Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 476 days.

(21) Appl. No.: 12/545,019

(22) Filed: Aug. 20, 2009

(65) Prior Publication Data

US 2010/0045644 A1 Feb. 25, 2010

(30) Foreign Application Priority Data

Aug. 20, 2008 (KR) ..... 10-2008-0081465

(51) Int. Cl.
*G09G 3/36* (2006.01)

(52) U.S. Cl. ..... 345/89; 345/99

(58) Field of Classification Search ..... 345/208, 345/87, 88.89, 99, 100, 690
See application file for complete search history.

(56) References Cited

U.S. PATENT DOCUMENTS

2005/0253794 A1* 11/2005 Lee et al. ..... 345/87
2006/0146005 A1* 7/2006 Baba et al. ..... 345/102

FOREIGN PATENT DOCUMENTS

JP 2007-219034 8/2007
KR 2006-0129094 12/2006
KR 2007-0049909 5/2007

* cited by examiner

*Primary Examiner* — Chanh Nguyen
*Assistant Examiner* — Jonathan Blancha
(74) *Attorney, Agent, or Firm* — Innovation Counsel LLP

(57) ABSTRACT

In a method of driving a display device and a driving circuit using the driving method, when a current needed to display an image corresponding to one frame is calculated based on a data signal, a second vertical start signal delayed by a first time interval more than a first vertical start signal based on the calculated current. A first gate signal is sequentially output in response to the first vertical start signal, and a display data voltage obtained from the data signal is output during a high period of the first gate signal. A second gate signal is sequentially output in response to the second vertical start signal, and a black data voltage is output during a high period of a second gate signal. Thus, the current applied to a display part is controlled, thereby reducing power consumption and improving moving image.

17 Claims, 16 Drawing Sheets

METHOD OF DRIVING DISPLAY DEVICE TO CONTROL OVER-CURRENT, CIRCUIT OF DRIVING DISPLAY DEVICE USING THE METHOD AND DISPLAY DEVICE HAVING THE SAME

CROSS-REFERENCE TO RELATED APPLICATION

This application relies for priority upon Korean Patent Application No. 2008-81465 filed on Aug. 20, 2008, the contents of which are herein incorporated by reference in their entirety.

BACKGROUND

1. Field of the Invention

The present invention relates to a method of driving a display device, a driving circuit for a display device using the same and a display device having the driving circuit. More particularly, the present invention relates to a driving method for a display device, a driving circuit for a display device using the driving method and a display device having the driving circuit, capable of controlling a current applied to a display part according to an input data signal.

2. Description of the Related Art

In general, an organic electroluminescent light emitting display device has been developed as a flat panel display device using the electroluminescent light emitting phenomenon of an organic material. The organic electroluminescent light emitting display device includes an anode electrode, a cathode electrode and an organic light emitting material disposed between the anode and cathode electrodes. The organic electroluminescent light emitting display device applies currents to the organic light emitting material to generate lights, and displays images using the light.

However, if over-currents are applied to the organic light emitting material, power consumption of the organic electroluminescent light emitting display device increases, thereby shortening its lifespan.

SUMMARY

Therefore, the present invention provides a method of driving a display device, the method being capable of reducing power consumption and improving display quality of a moving image.

The present invention also provides a driving circuit using the method of driving the display device.

The present invention also provides a display device having the driving circuit.

In an exemplary embodiment of the present invention, a method of driving a display device is provided as follows. When a first vertical start signal is generated, a current to display an image corresponding to one frame is calculated based on a data signal, and a second vertical start signal, which is delayed from the first vertical start signal by a first time interval, is generated, the first time interval being based on the calculated current. Then, a first gate signal is sequentially output in response to the first vertical start signal, and the data signal is converted to output a display data voltage during a high period of the first gate signal. When a second gate signal is sequentially output in response to the second vertical start signal, a black data voltage is output during a high period of the second gate signal.

In another exemplary embodiment of the present invention, a driving circuit for a display device includes a timing controller, a start signal generator, a gate driver, and a data driver.

The timing controller generates a first vertical start signal and outputs a data signal. The start signal generator calculates a current to display an image of one frame based on the data signal and generates a second vertical start signal delayed by a first time interval from the first vertical start signal based on the calculated current. The gate driver sequentially outputs a first gate signal in response to the first vertical start signal and sequentially outputs a second gate signal in response to the second vertical start signal. The data driver converts the data signal to output a display data voltage during a high period of the first gate signal and outputs a black data voltage during a high period of the second gate signal.

In another exemplary embodiment of the present invention, a display device includes a timing controller, a start signal generator, a gate driver, a data driver, and a display part.

The timing controller generates a first vertical start signal and outputs a data signal. The start signal generator calculates a current to display an image corresponding to one frame based on the data signal and generates a second vertical start signal delayed by a first time interval from the first vertical start signal, wherein the first time interval is based on the calculated current. The gate driver sequentially outputs a first gate signal in response to the first vertical start signal and sequentially outputs a second gate signal in response to the second vertical start signal. The data driver converts the data signal into a display data voltage to output the display data voltage during a high period of the first gate signal and outputs the black data voltage during a high period of the second gate signal. The display part receives the display data voltage and the black data voltage to display a display image and a black image.

According to the above, the output timing of the second vertical start signal is adjusted according to the current applied to the organic electroluminescent light emitting display part, and thus a size of a black area in which the black image is displayed may be adjusted, thereby preventing the over-current from being applied to the organic electroluminescent light emitting display part. In addition, the black image is inserted into the normal image, thereby removing the image dragging phenomenon in the hold type display mode and improving the image display quality.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

Hereinafter, the present invention will be explained in detail with reference to the accompanying drawings.

Figure 1:
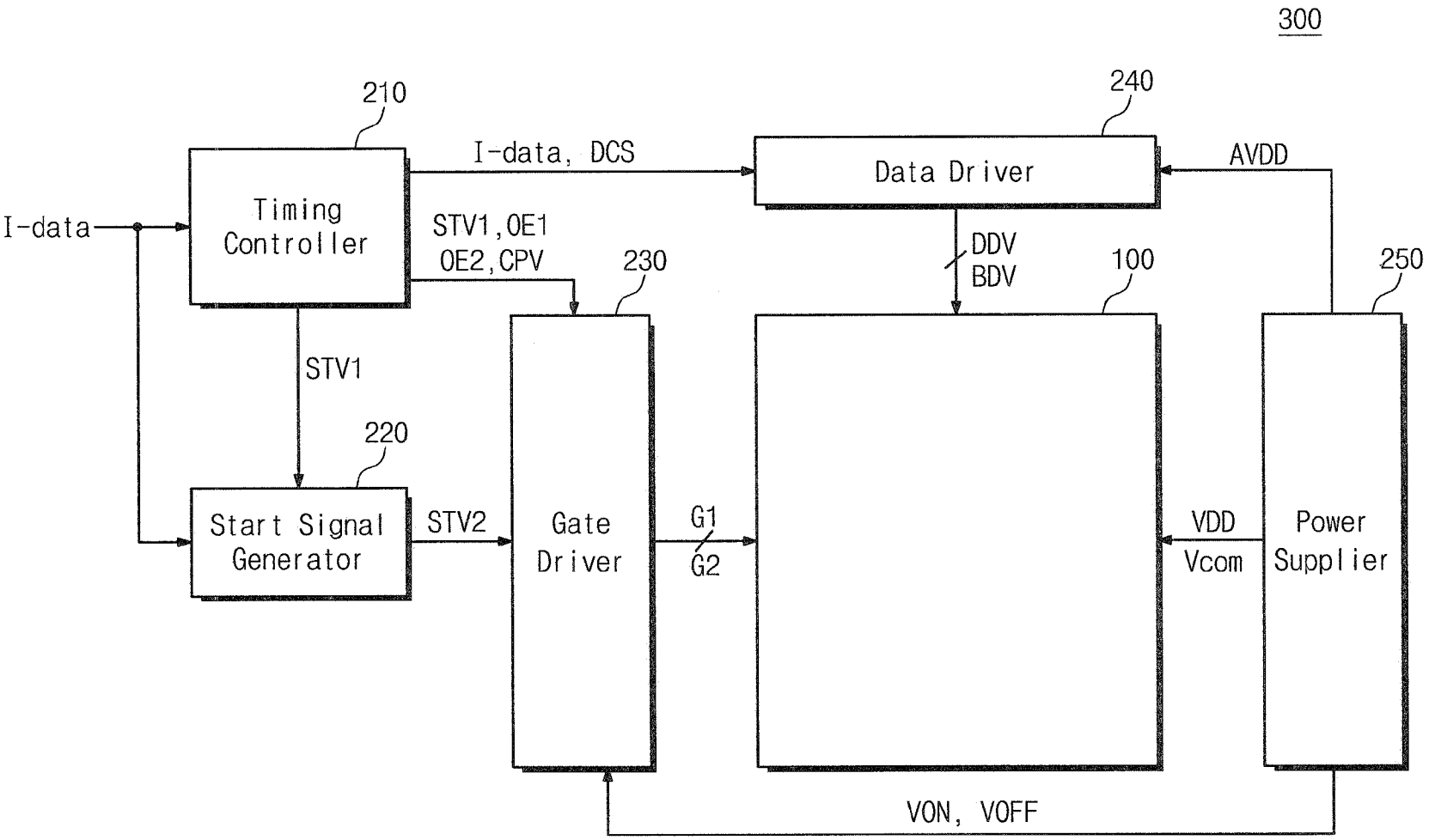
FIG. 1 is a block diagram showing an organic electroluminescent light emitting display device according to an exemplary embodiment of the present invention.
Figure 2:
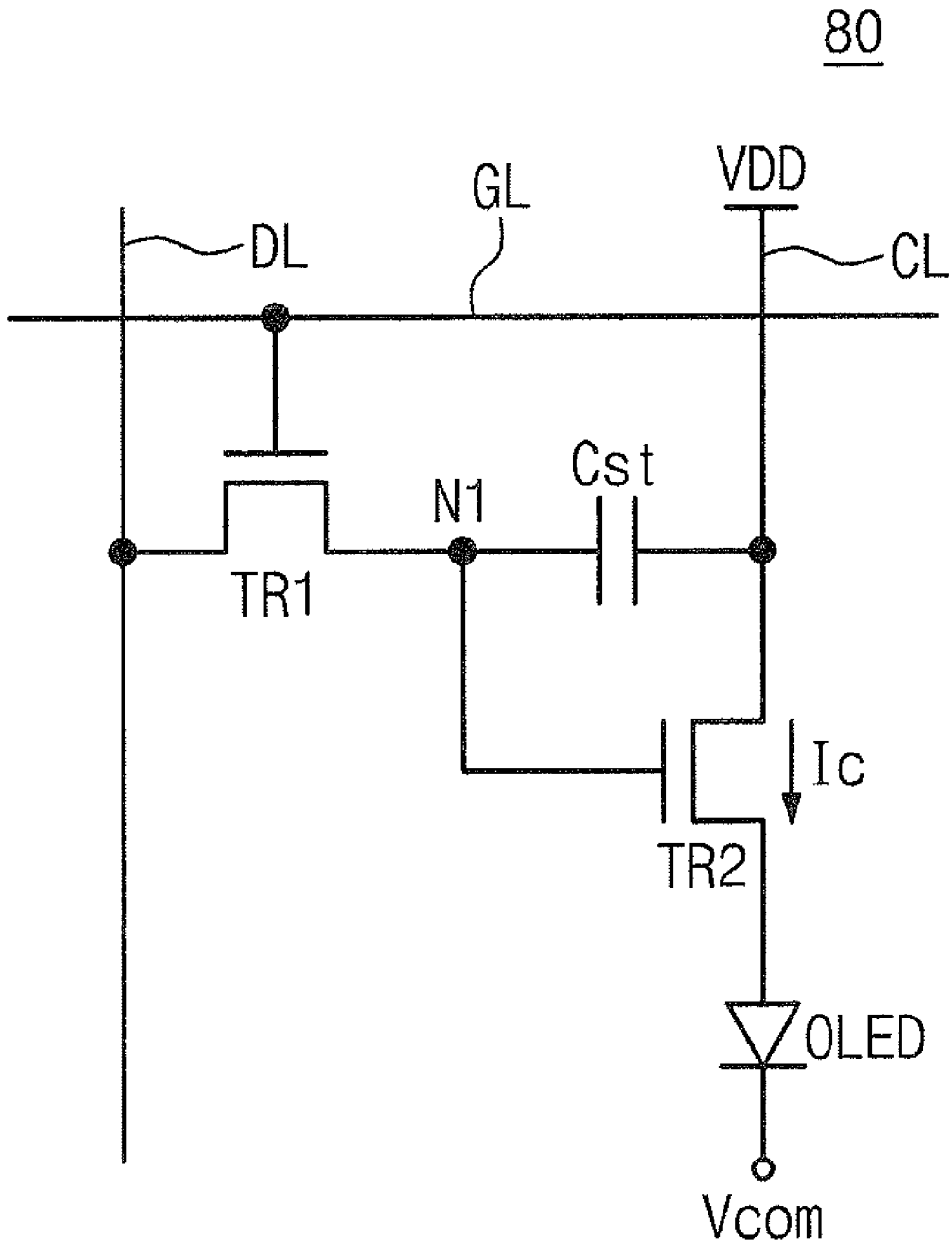
FIG. 2 is a circuit diagram showing a pixel cell included in an organic electroluminescent light emitting display part of FIG. 1.

FIG. 1 is a block diagram showing an organic electroluminescent light emitting display device according to an exemplary embodiment of the present invention. FIG. 2 is a circuit diagram showing a pixel cell included in the organic electroluminescent light emitting display part of FIG. 1.

Referring to FIGS. 1 and 2, an organic electroluminescent light emitting display device 300 includes an organic electroluminescent light emitting display part 100, a timing controller 210, a start signal generator 220, a gate driver 230, a data driver 240, and a power supplier 250.

The organic electroluminescent light emitting display part 100 includes a plurality of gate lines, a plurality of data lines, the data lines crossing the gate lines, and a plurality of pixel cells formed in the regions between the gate lines and the data lines.

FIG. 2 is a circuit diagram showing a gate line GL, a data line DL crossing the gate line GL, a pixel cell 80 formed in a region defined by the gate line GL and the data line DL, and a power supply line CL supplying a power voltage to the pixel cell 80. In the present exemplary embodiment, as shown in FIG. 2, the pixel cell 80 includes an organic light emitting diode OLED, first and second transistors TR1 and TR2 that are used for controlling the organic light emitting diode OLED, and a storage capacitor Cst that may be charged with a data voltage that is applied to the first transistor TR1 via the data line DL.

The gate line GL supplies a gate signal from the gate driver 230 to the pixel cell 80. The first transistor TR1 is turned on in response to the gate signal since a gate electrode of the first transistor TR1 is connected to the gate line GL. The data line DL supplies the data voltage from the data driver 240 to the first transistor TR1.

When the first transistor TR1 is turned on in response to the gate signal, the data voltage from the data line DL is applied to a first node N1 through the first transistor TR1. The storage capacitor Cst is charged with the data voltage applied to the first node N1 and the second transistor TR2 is turned on. When the first transistor TR1 is turned off, the data voltage stored in the storage capacitor Cst is still applied to the gate electrode of the second transistor TR2, so that the second transistor TR2 remains turned on. The second transistor TR2 remains turned on, so that a driving voltage VDD is applied to the organic light emitting diode OLED through the power supply line CL until the data voltage stored in the storage capacitor Cst is completely discharged. In the present exemplary embodiment, both NMOS and PMOS transistors may be used as the first and second transistors TR1 and TR2.

The organic light emitting diode OLED is formed on a substrate for the organic electroluminescent light emitting display part 100, and includes an anode electrode, a cathode electrode and an organic light emitting layer interposed between the anode and cathode electrodes, wherein the organic light emitting layer may include red, green and blue light emitting materials. The organic light emitting layer includes a hole injection layer, a hole transfer layer, a light emitting layer, an electron transfer layer, and an electron injection layer, which are sequentially stacked. The anode electrode is connected to an output terminal of the second transistor TR2, and the cathode electrode is connected to a ground voltage or a common voltage Vcom having a voltage level lower than a voltage applied to the anode electrode. The organic light emitting diode OLED is operated by a current Ic that is controlled by a voltage difference between the gate and source electrodes of the second transistor TR2.

Referring to FIG. 1, the timing controller 210 receives a data signal I-data from an exterior source and applies the data signal I-data to the data driver 240. Also, the timing controller 210 applies gate control signals and data control signals DCS to the gate and data drivers 230 and 240, respectively, based on signals received from the exterior source. As an example of the present invention, the gate control signal includes a first vertical start signal STV1, a first output enable signal OE1, a second output enable signal OE2 having a phase delayed from a phase of the first output enable signal OE1 by a predetermined time, and a clock pulse signal CPV.

The start signal generator 220 receives the data signal I-data from the exterior source and calculate a current to display one frame. Based on the current value, the start signal generator 220 generates a second vertical start signal STV2 delayed from the first vertical start signal STV1 by a first time interval. The second vertical start signal STV2 generated by the start signal generator 220 is applied to the gate driver 230.

The gate driver 230 sequentially outputs a first gate signal G1 corresponding to a first period of the first output enable signal OE1 in response to the first vertical start signal STV1, and sequentially outputs a second gate signal G2 corresponding to a second period of the second output enable signal OE2 in response to the second vertical start signal STV2. In the present exemplary embodiment, the first and second periods are defined as low periods of the first and second output enable signals OE1 and OE2, respectively.

The gate lines GL arranged in the organic electroluminescent light emitting display part 100 begin to sequentially receive the first gate signal G1 at a first time point at which the first vertical start signal STV1 is generated, and begin to sequentially receive the second gate signal G2 at a second time point at which the first time interval has elapsed after the first time point and the second vertical start signal STV2 is generated.

The data driver 240 outputs a display data voltage DDV corresponding to a high period of the first gate signal G1 and outputs a black data voltage BDV to display a black image corresponding to a high period of the second gate signal G2. The data driver 240 converts the data signal I-data that it receives from the timing controller 210 into an analog form to apply the display data voltage DDV to the data line DL. The display data voltage DDV and the black data voltage BDV are alternately output from the data driver 240, and thus the organic electroluminescent light emitting display part 100, which is divided into two portions according to a black data ratio, displays images corresponding to the display data voltage DDV through a portion thereof and the black image corresponding to the black data voltage BDV through another portion thereof.

The power supplier 250 applies a gate-on voltage VON and a gate-off voltage VOFF to the gate driver 230, applies an analog driving voltage AVDD to the data driver 240, and applies the driving voltage VDD and the common voltage Vcom to the organic electroluminescent light emitting display part 100.

Figure 3:
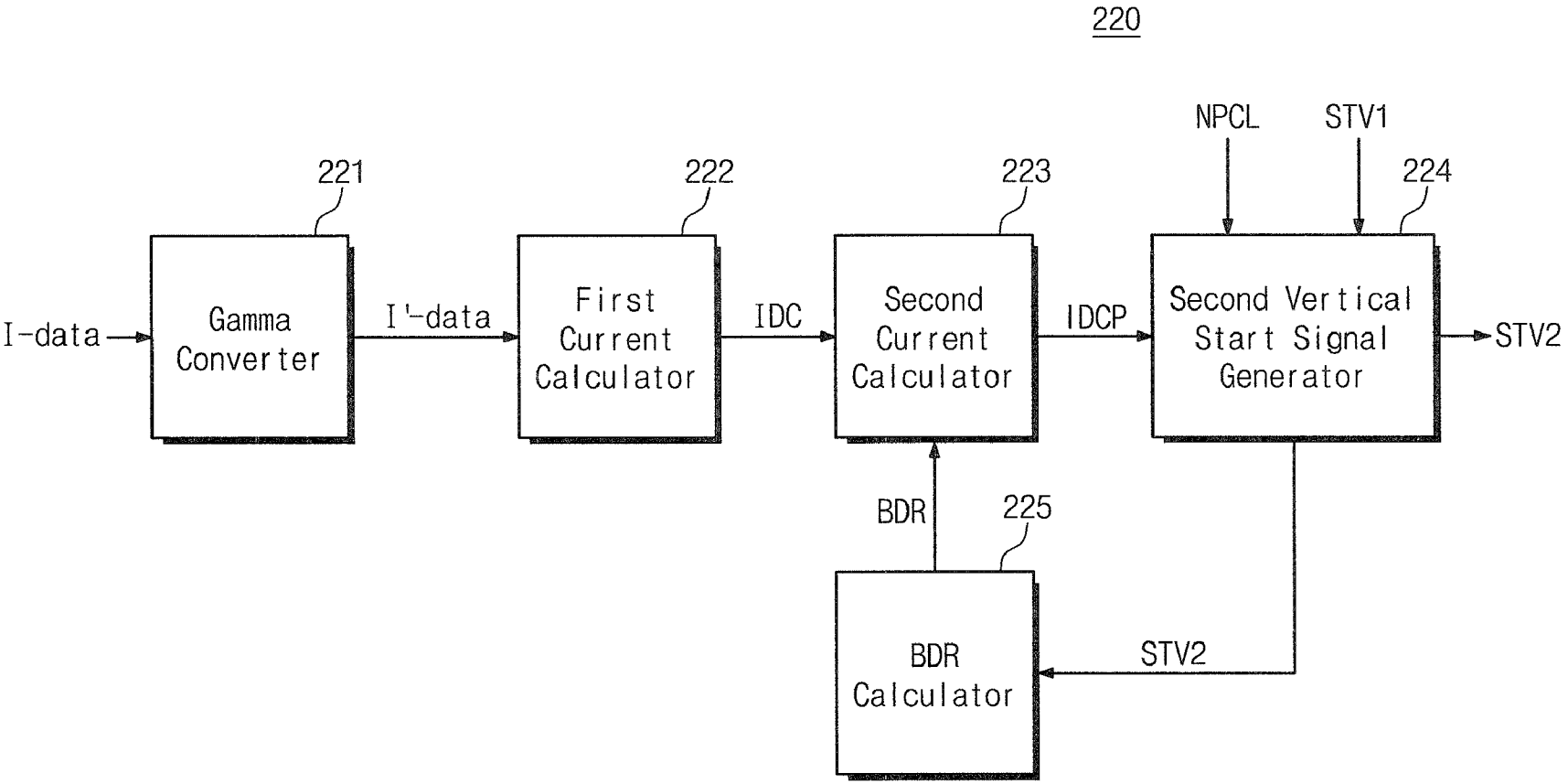
FIG. 3 is a block diagram showing a start signal generator of FIG. 1 according to an exemplary embodiment of the present invention.
Figure 4:
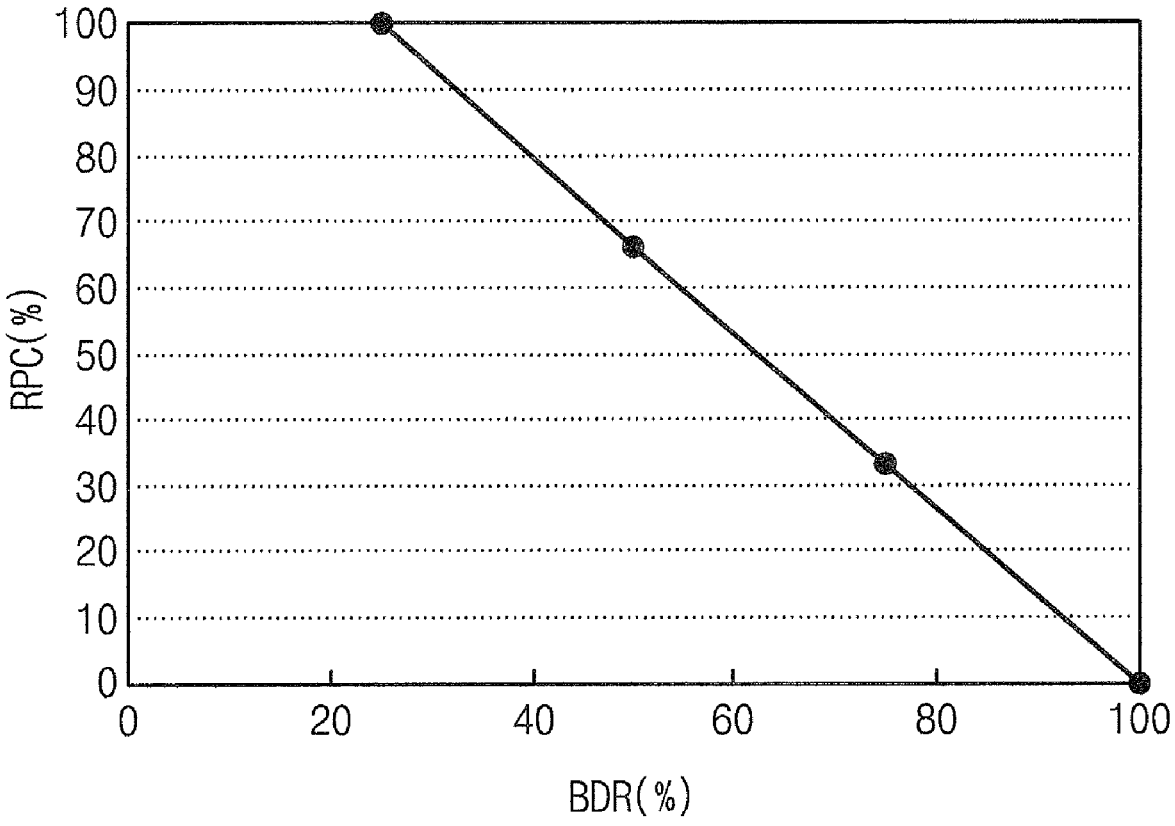
FIG. 4 is a graph showing a relation between a black data ratio BDR and a second current ratio RPC of FIG. 3.

FIG. 3 is a block diagram showing a start signal generator of FIG. 1, and FIG. 4 is a graph showing a relation between the black data ratio BDR and a second current ratio RPC of FIG. 3. In FIG. 4, the x-axis indicates the BDR and the y-axis indicates the second current ratio RPC, both shown as percentages.

Referring to FIG. 3, the start signal generator 220 includes a gamma converter 221, a first current calculator 222, a second current calculator 223, a second vertical start signal generator 224, and a black data ratio BDR calculator 225.

The gamma converter 221 converts a gray scale of the data signal I-data corresponding to one frame and supplies the converted data signal I'-data to the first current calculator 222. The gamma converter 221 converts the data signal I-data using a gamma function, and the gamma function may be an exponential function. In the present exemplary embodiment, the gamma value (γ) is a constant value in the range of 1.8 to 3.

The first current calculator 222 calculates a current (hereinafter, referred to as a first current IDC) corresponding to the data signal I'-data using the data signal I'-data from the gamma converter 221, the first current IDC corresponding to one complete frame converted by the gamma converter 221.

The second current calculator 223 receives the first current IDC and calculates a second current IDCP that is equal to the first current IDC multiplied by a second current ratio RPC that is based on a black data ratio BDR of the previous frame.

As shown in FIG. 4, the second current ratio RPC is a function of the black data ratio BDR. The graph shown in FIG. 4 is obtained under an assumption that the second current ratio RPC is 100% when the black data ratio BDR is 25%, and thus the second current ratio RPC and the second current IDCP satisfy equations 1 and 1a as follows.

$$RPC(\%)=133.33-1.34\text{sBDR} \quad \text{Equation 1a}$$

$$IDCP=IDC*RPC(\%) \quad \text{Equation 1b}$$

In equation 1, BDR represents a previous BDR corresponding to a previous frame, and the previous BDR is provided from the BDR calculator 225.

The second vertical start signal generator 224 compares the second current IDCP, calculated based on equation 1, with a reference current NPCL to generate the second vertical start signal STV2. The second vertical start signal STV2 is generated after a first time interval elapses from the generation of the first vertical start signal STV1 by the timing controller 210.

Figure 5:
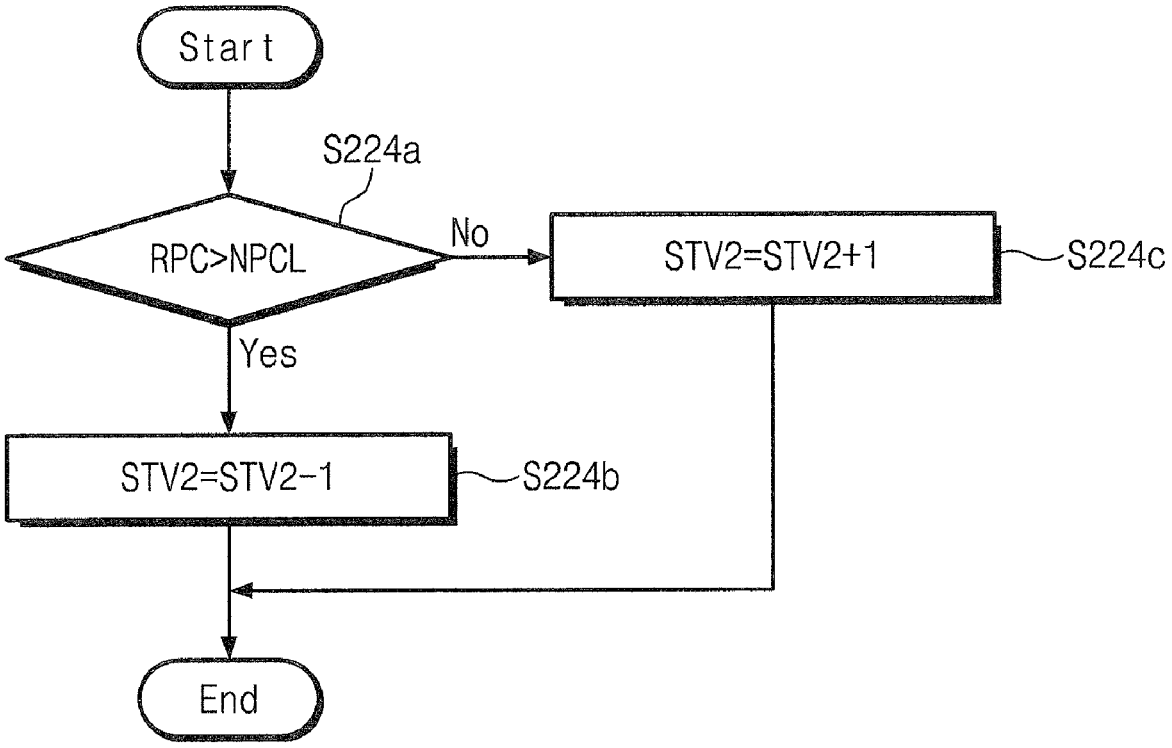
FIG. 5 is a flow chart illustrating an operation of a second vertical start signal generator of FIG. 3.

FIG. 5 is a flow chart illustrating an operation of a second vertical start signal generator of FIG. 3.

Referring to FIG. 5, the second vertical start signal generator 224 compares the second current IDCP with the reference current NPCL to determine whether the second current IDCP is greater than the reference current NPCL or not (S224*a*).

When the second current IDCP is greater than the reference current NPCL, the second vertical start signal STV2 decreases by 1 (S224*b*), and when the second current IDCP is equal to or smaller than the reference current NPCL, the second vertical start signal STV2 increases by 1 (S224*c*). In the present exemplary embodiment, "1" may be defined as a time corresponding to the high period of the first gate signal G1 or the second gate signal G2.

The second vertical start signal STV2 generated by the second vertical start signal generator 224 is provided to the BDR calculator 225. Accordingly, the BDR calculator 225 may calculate a black data ratio BDR of a present frame based on the second vertical start signal STV2.

In particular, when the second vertical start signal STV2 decreases, a time in which the black image is displayed increases, so that the black data ratio BDR of the present frame increases. Conversely, when the second vertical start signal STV2 increases, the time in which the black image is displayed decreases, so that the black data ratio BDR of the present frame decreases.

The present black data ratio BDR, calculated by the above method, may be used to calculate the second current IDCP of a next frame.

Figure 6:
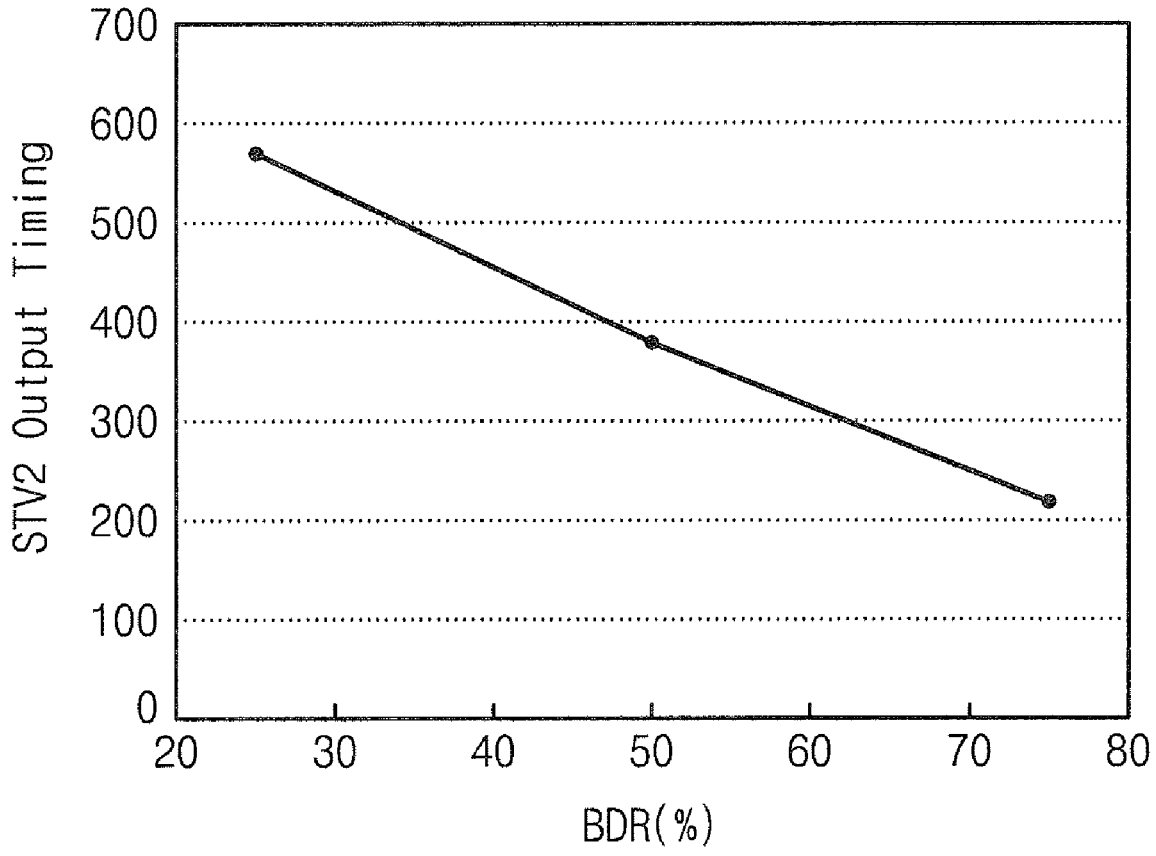
FIG. 6 is a graph showing an output timing of the second vertical start signal versus the black data ratio BDR.

FIG. 6 is a graph showing an output timing or generation timing of the second vertical start signal according to the black data ratio BDR. In FIG. 6, on the assumption that the organic electroluminescent display part includes 768 gate lines, the output timing of the second vertical start signal is represented by the number of the gate line to which the gate signal is applied when the second vertical start signal is output. In FIG. 6, for convenience, it is assumed that the black image extends to the $768^{th}$ gate line.

As shown in FIG. 6, the output timing or generation timing of the second vertical start signal STV2 is advanced to increase the black data ratio BDR, and the output timing or generation timing of the second vertical start signal STV2 is delayed to decrease the black data ratio BDR.

In other words, when the black data ratio BDR is about 50%, the second vertical start signal STV2 is output right after the first gate signal is output to the 384-th gate line of 768 gate lines in the organic electroluminescent display part 100 (refer to FIG. 1). When the black data ratio BDR is reduced to about 25%, the second vertical start signal STV2 is output right after the first gate signal is applied to 576 gate lines corresponding to 75% of the 768 gate lines (e.g., right after the gate signal is applied to the 576-th gate line of 768 gate lines). When the BDR ratio increases to about 75%, the second vertical start signal STV2 is output right after the gate signal is applied to 192 gate lines corresponding to 25% of the 768 gate lines (e.g., right after the gate signal is applied to the 192-th gate line of 768 gate lines).

As described above, since the output timing or generation timing of the second vertical start signal STV2 is controlled according to the current applied to the organic electroluminescent display part 100, a size of a black area in which the black image is displayed may be adjusted, thereby preventing over-currents from being applied to the organic electroluminescent display part 100.

In addition, the black image is inserted between display images, so that image dragging phenomenon in a hold type image display mode may be prevented and image display quality of the moving image may be improved.

Figure 7:
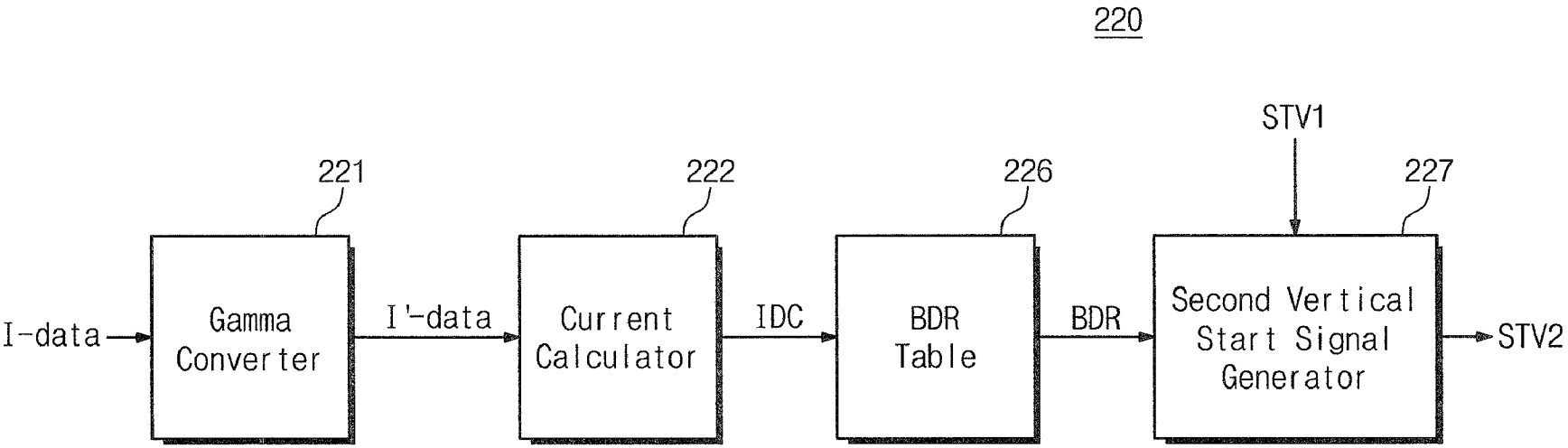
FIG. 7 is a block diagram showing a start signal generator of FIG. 1 according to another embodiment of the present invention.
Figure 8:
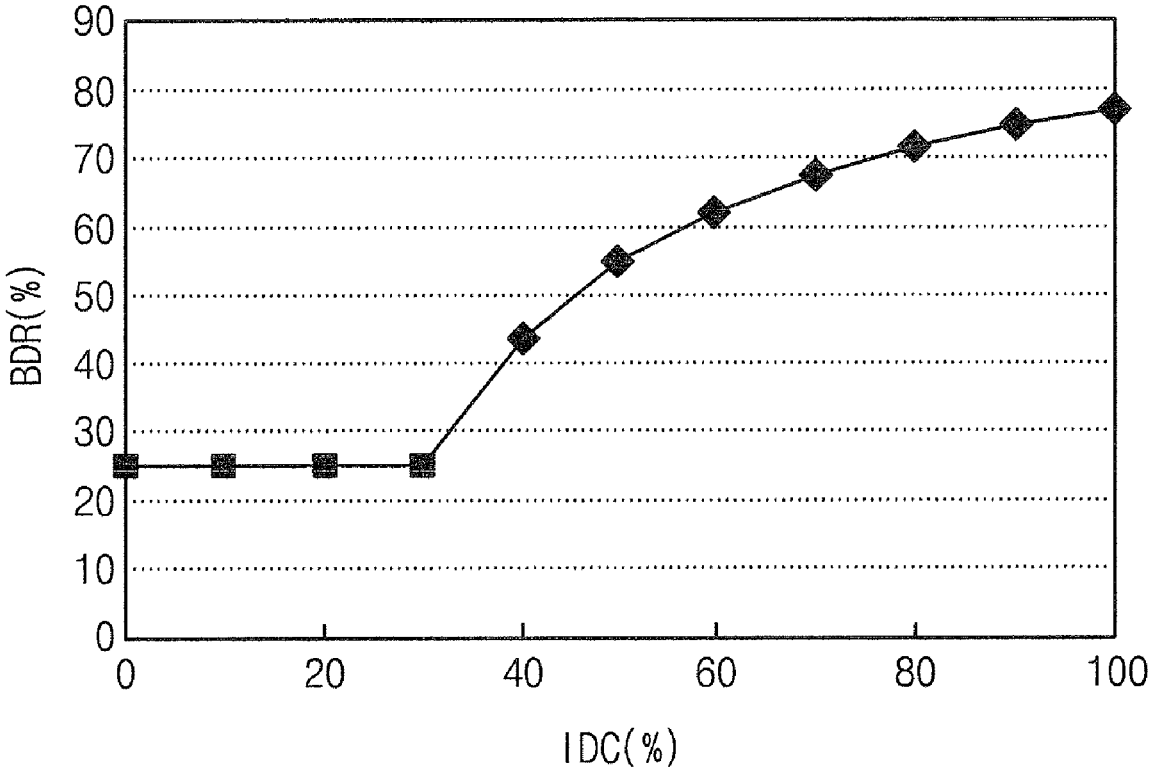
FIG. 8 is a graph showing a black data ratio BDR versus a first current.

FIG. 7 is a block diagram showing a start signal generator of FIG. 1, according to another embodiment of the invention, and FIG. 8 is a graph showing a black data ratio BDR versus a first current. In FIG. 7, the same reference numerals denote the same elements in FIG. 3, and thus the detailed descriptions of the same elements are omitted here.

Referring to FIG. 7, the start signal generator 220 includes a gamma converter 221, a current calculator 222, a BDR table 226, and a second vertical start signal generator 227.

The BDR table 226 outputs a black data ratio BDR that limits the current consumed in the organic electroluminescent light emitting display part 100 not to exceed the reference current NPCL in response to the first current IDC provided from the current calculator 222. The BDR table 226 may include a lookup table.

According to the graph shown in FIG. 8, on the assumption that the reference current NPCL is about 30%, when the first current IDC is greater than the reference current NPCL, the BDR satisfies an equation 2 as follows.

$$BDR(\%) = \frac{\left(\left(\frac{NPCL}{IDC}\right)\times 100 - 133.33\right)}{1.34} \quad \text{Equation 2}$$

When the first current IDC is equal to or smaller than the reference current NPCL of 30%, the BDR may be limited to about 25%.

Thus, the BDR calculated based on the first current IDC and equation 2 may be stored in the BDR table 226.

Referring again to FIG. 7, the second vertical start signal generator 227 generates a second vertical start signal STV2, the generation timing of the second vertical start signal being modified based on the BDR provided from the BDR table 226. Accordingly, the gate driver may be controlled such that the black image according to a desired BDR is displayed.

Figure 9:
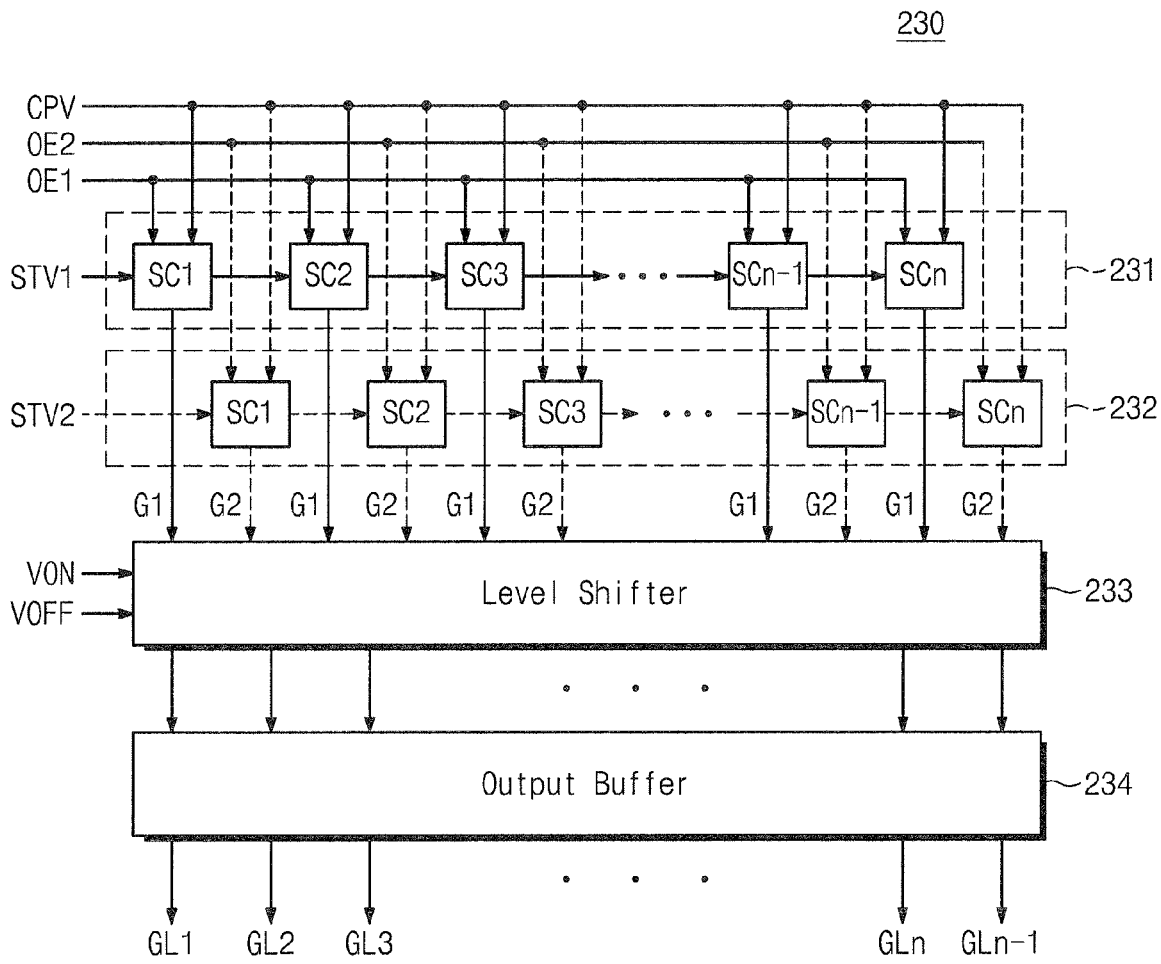
FIG. 9 is a block diagram showing a gate driver of FIG. 1.
Figure 10:
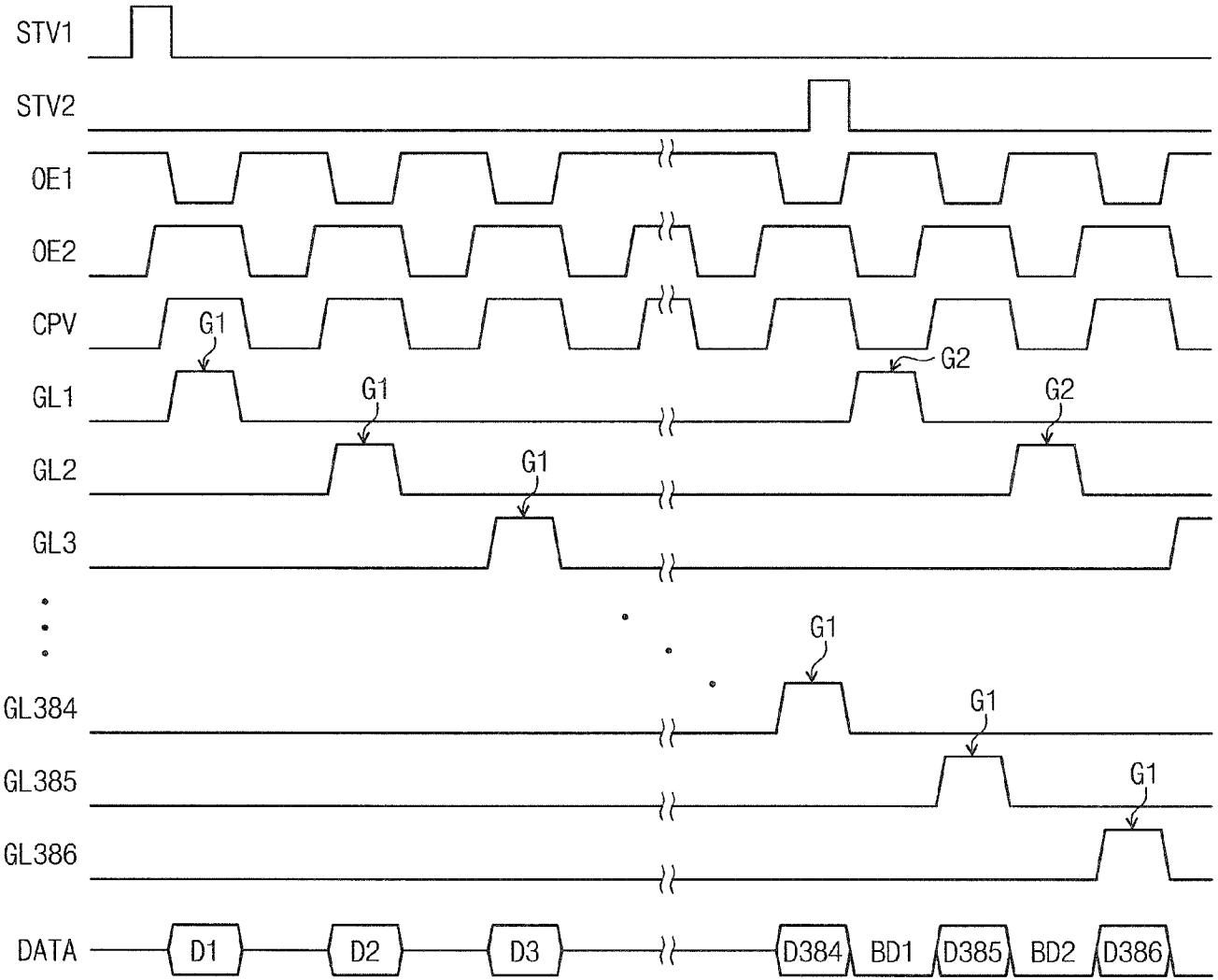
FIG. 10 is a waveforms diagram of signals of FIG. 9.
Figure 11A:
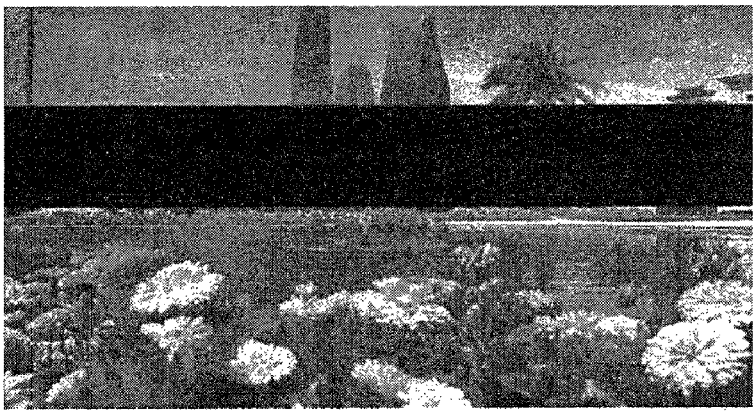
FIGS. 11A to 11D are views showing screens to which a BDR of 25% is applied.
Figure 11B:
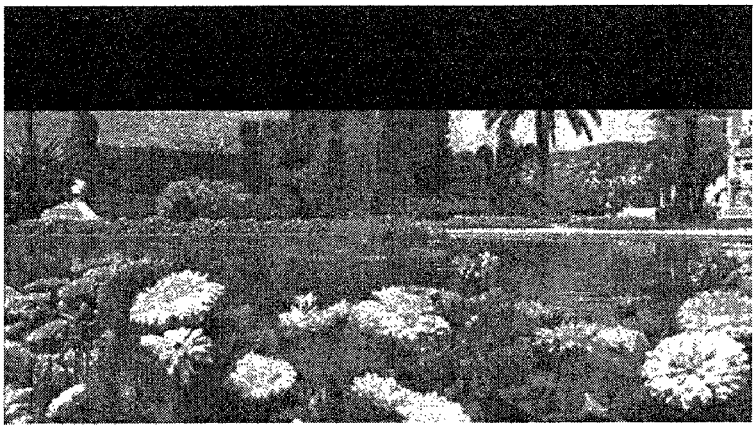
Figure 11C:
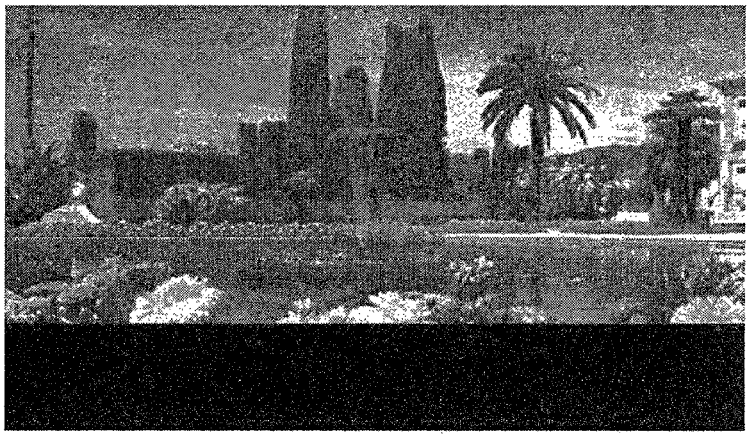
Figure 11D:
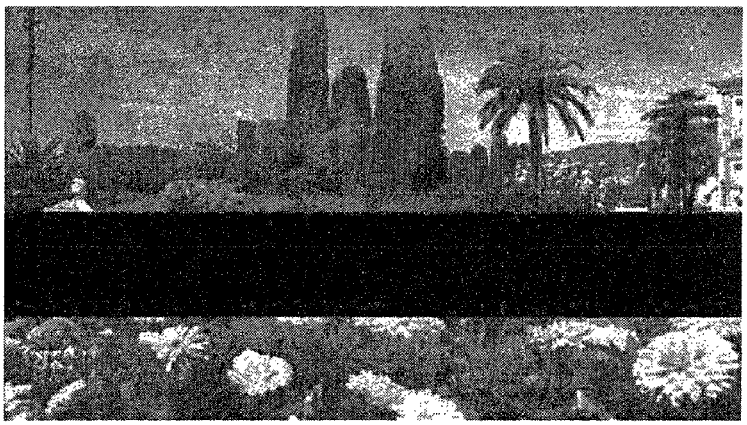
Figure 12A:
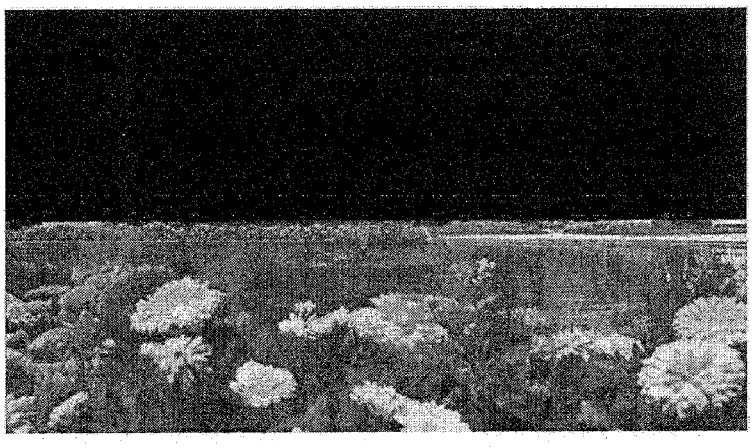
FIGS. 12A to 12D are views showing screens to which a BDR of 50% is applied.
Figure 12B:
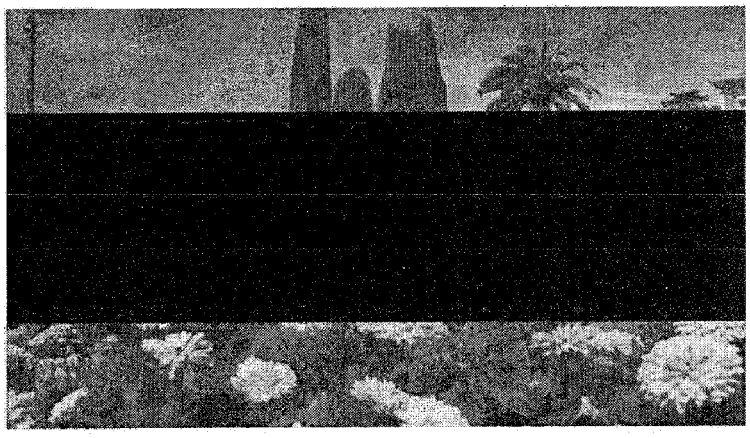
Figure 12C:
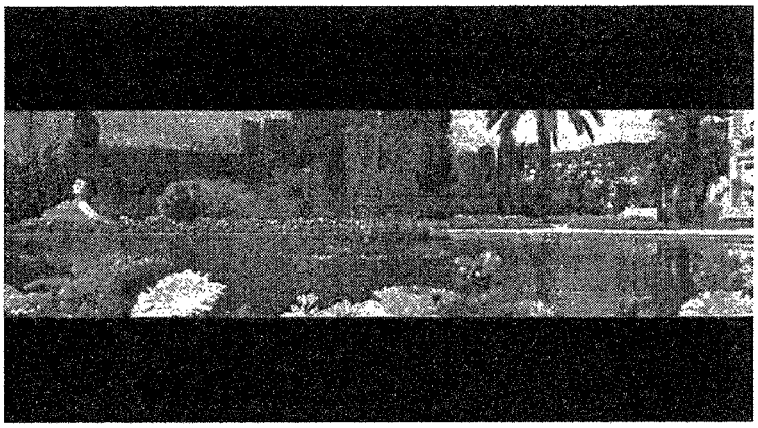
Figure 12D:
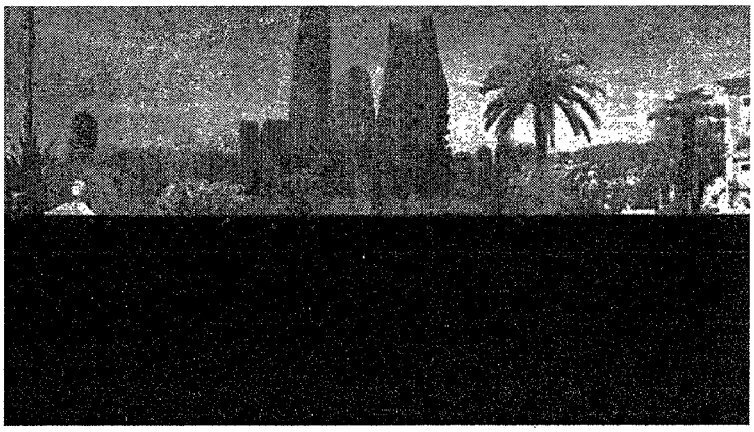
Figure 13A:
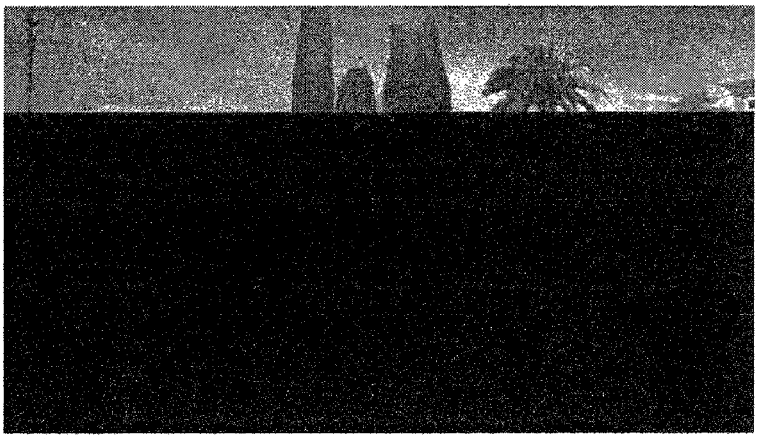
FIGS. 13A to 13D are views showing screens to which a BDR of 75% is applied.
Figure 13B:
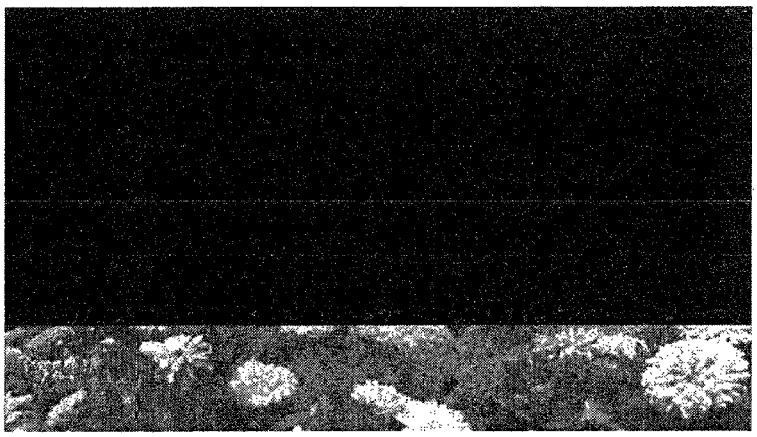
Figure 13C:
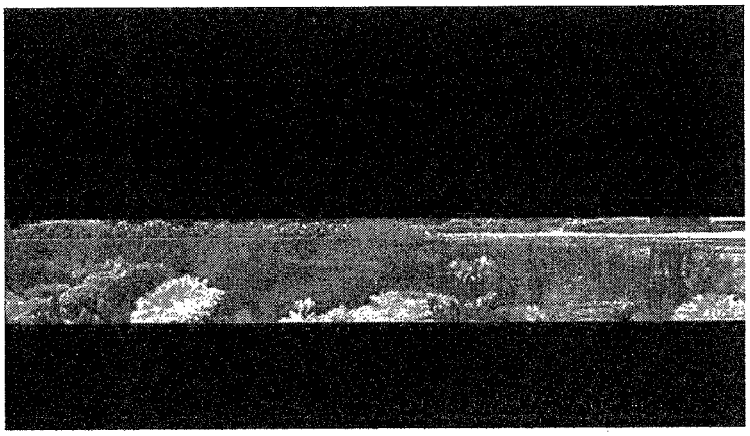
Figure 13D:
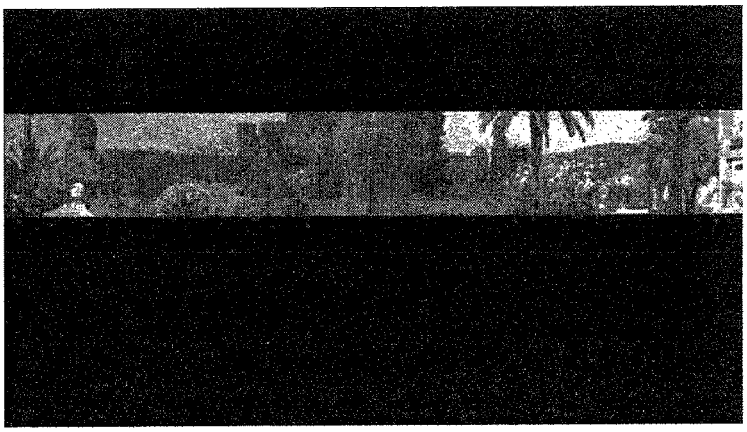

FIG. 9 is a block diagram showing a gate driver of FIG. 1, and FIG. 10 is a waveforms diagram of signals associated with the gate driver of FIG. 9.

Referring to FIGS. 9 and 10, the gate driver 230 includes first and second shift registers 231 and 232, a level shifter 233, and an output buffer 234.

The first shift register 231 includes plural stages SC1~SCn connected to each other one after another and receives the first vertical start signal STV1, the first output enable signal OE1, and the clock pulse signal CPV.

The first vertical start signal STV1 is applied to a first stage SC1 of the stages SC1~SCn of the first shift register 231 to start an operation of the first shift register 231. Each stage of the first shift register 231 receives the first output enable signal OE1 and the clock pulse signal CPV and sequentially outputs the first gate pulses G1. An interval period is disposed between consecutive two first gate pulses G1.

The second shift register 232 includes plural stages SC1~SCn connected to each other one after another and receives the second vertical start signal STV2, the second output enable signal OE2 and the clock pulse signal CPV.

The second vertical start signal STV2 is applied to a first stage SC1 of the stages SC1~SCn of the second shift register 232 to start an operation of the second shift register 232. Each stage of the second shift register 232 receives the second output enable signal OE2 and the clock pulse signal CPV and sequentially outputs the second gate pulses G2. Each of the second gate pulse G2 is generated for corresponding the interval period of the first gate pulses G1.

For example, the second gate pulse G2 is generated for the interval period between 384-th gate line GL384 and 385-th gate line GL385 and applied to the first gate line GL1.

Since the first and second vertical start signals STV1 and STV2 are generated at the different times from each other, the first and second shift registers 231 and 232 start their operation at the different times from each other.

The level shifter 233 receives the gate-on voltage VON and the gate-off voltage VOFF and converts the first and second gate pulses G1 and G2 from the first and second shift registers 231 and 232 to the gate-on voltage VON and the gate-off voltage VOFF, respectively. The output buffer 234 calculates a load of the gate lines GL1~GLn to amplify the first and second gate pulses G1 and G2.

Referring to FIGS. 9 and 10, when the first shift register 231 starts its operation in response to the first vertical start signal STV1, the first gate pulses G1 are output from the first shift register 231 while the first output enable signal OE1 is in low state and the clock pulse signal CPV is in high state. The first gate pulses G1 output from the first shift register 231 are sequentially applied to the gate lines GL1~GLn.

Assuming that the number of the gate lines GL1~GLn is 768 and the BDR is about 50%, the second vertical start signal STV2 is generated when the first gate signal G1 is applied to 384-th gate line GL384. The second shift register 232 starts its operation in response to the second vertical start signal STV2. The second shift register 232 outputs the second gate pulses G2 when the second output enable signal OE2 is in low state and the clock pulse signal CPV is in low state. The second gate pulses G2 from the second shift register 232 are sequentially applied to the gate lines GL1~GLn at the different times from the first gate pulses G1. That is, the second gate signal G2 is applied to the first gate line GL1 during an interval period between the first gate pulse G1 applied to the 384-th gate line GL384 and the first gate pulse G1 applied to 385-th gate line GL385.

During a period in which the first gate pulses G1 are applied to the gate lines GL1~GLn, the display data voltages D1, D2, D3, . . . , D384, D385 and D386 are applied to the data lines. Meanwhile, during the interval period in which the second gate pulses G2 are applied to the gate lines GL1~GLn, the black data voltages BD1 and BD2 for the black images are applied to the data lines. The data driver 240 (refer to FIG. 1) outputs only the display data voltages D1, D2, D3, . . . , D384, D385 and D386 during the period in which the first gate line GL1 to the 384-th gate line are operated, but the data driver 240 outputs alternately the display data voltages D1, D2, D3, . . . , D384, D385 and D386 and the black data voltages BD1 and BD2 from the time point where the second gate pulses G2 are output (e.g., a time point where the 385-th gate line GL385). Thus, one screen image may include a region in which the black images corresponding to the black data voltages BD1 and BD2 are displayed.

FIGS. 11A to 11D are views showing screens to which a BDR of about 25% is applied, FIGS. 12A to 12D are views showing screens to which a BDR of about 50% is applied, and FIGS. 13A to 13D are views showing screens to which a BDR of about 75% is applied.

FIGS. 11A to 11D show images that are displayed in four sequential frames. As shown in FIGS. 11A to 11D, in case that the BDR is set to about 25%, the black image starts to be displayed at the time point where the normal image corresponding to about 75% of one frame is displayed. Accordingly, the normal image and the black image are displayed in a ratio of 3:1 during one frame. In FIGS. 11A-11D, the black image occupies about 25% or one quarter of each frame and moves upwards one quarter frame in each successive frame.

As shown in FIGS. 12A to 12D, in case that the BDR increases to about 50%, the black image starts to be displayed at the time point where the normal image corresponding to about 50% of one frame is displayed, so that the normal image and the black image are displayed in a ratio of 1:1 during one frame. In FIGS. 12A-12D, the black image occupies about 50% of each frame and moves upward one quarter frame in each successive frame.

In addition, as shown in FIGS. 13A to 13D, in case that the BDR increases to about 75%, the black image starts to be displayed at the time point where the normal image corresponding to about 25% of one frame is displayed, so that the normal image and the black image are displayed in a ratio of 1:3 during one frame. In FIGS. 13A-13D, the black image occupies about 75% of each frame and moves upward one quarter frame in each successive frame.

As described above, the size of the black area in one screen image varies according to the BDR. The BDR is decided depending upon the current applied to the organic electroluminescent light emitting display part. That is, the BDR decreases as the current decreases and the BDR increases as the current increases, and thus the size of the black area in which the black image is displayed varies.

In addition, the display device may prevent the over-current from being applied to the organic electroluminescent light emitting display part since the size of the black area is adjusted. Also, the black image is inserted into the normal image, thereby removing the image dragging phenomenon in the hold type display mode and improving the image display quality.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method of a driving a display device, comprising:

generating a first vertical start signal;

calculating a current to display an image corresponding to one frame based on a data signal and generating a second vertical start signal delayed from the first vertical start signal by a first time interval, wherein the first time interval is determined based on the calculated current;

sequentially outputting a first gate signal in response to the first vertical start signal;

converting the data signal to output a display data voltage during a high period of the first gate signal;

sequentially outputting a second gate signal in response to the second vertical start signal; and outputting a black data voltage during a high period of the second gate signal, wherein the generating of the second vertical start signal comprises:

converting a gamma of the data signal;

calculating a first current using a data signal corresponding to a present frame of the converted data signal;

calculating a second current of the present frame based on a black data ratio of a previous frame and the first current; and comparing the second current and a predetermined reference current to decide a generation timing of the second vertical start signal.

2. The method of claim 1, wherein the generation timing of the second vertical start signal is advanced by a predetermined time interval when the second current is greater than the reference current, and the generation timing of the second vertical start signal is delayed by the predetermined time interval when the second current is smaller than the reference current.

3. The method of claim 2, wherein the predetermined time interval is equal to the high period of the first gate signal.

4. The method of claim 1, wherein the black data ratio of the previous frame is replaced based on the generation timing of the second vertical start signal of the present frame.

5. The method of claim 4, wherein the black data ratio of the previous frame increases when the second current is greater than the reference current, and the black data ratio of the previous frame decreases when the second current is smaller than the reference current.

6. The method of claim 1, wherein the generating of the second vertical start signal comprises:

converting a gamma of the data signal;

calculating the current using a data signal corresponding to one frame of the converted data signal;

outputting a black data ratio corresponding to the current; and deciding a generation timing of the second vertical start signal based on the black data ratio.

7. The method of claim 1, wherein the first gate signal is generated during a first period of a first gate control signal, and the second gate signal is generated during a second period of a second gate control signal having a phase delayed by a second time interval more than a phase of the first gate control signal.

8. The method of claim 7, wherein the first period of the first gate control signal and the second period of the second gate control signal are in a low period, and the low period of the second gate control signal is included in a high period of the first gate control signal.

9. A driving circuit for a display device, comprising:

a timing controller that generates a first vertical start signal and outputs a data signal;

a start signal generator that calculates a current to display an image of one frame based on the data signal and generates a second vertical start signal delayed by a first time interval from the first vertical start signal, wherein the first time interval is determined based on the calculated current;

a gate driver that sequentially outputs a first gate signal in response to the first vertical start signal and sequentially outputs a second gate signal in response to the second vertical start signal; and a data driver that converts the data signal to output a display data voltage during a high period of the first gate signal and outputs a black data voltage during a high period of the second gate signal, wherein the start signal generator comprises:

a gamma converter that converts a gamma of the data signal;

a first current calculator that calculates a first current using a data signal corresponding to a present frame of the converted data signal;

a second current calculator that calculates a second current based on the first current and a black data ratio of a previous frame; and a second vertical start signal generator that compares the second current and a predetermined reference current to decide a generation timing of the second vertical start signal.

10. The driving circuit of claim 9, wherein the second vertical start signal generator advances the timing of the second vertical start signal by a predetermined time interval when the second current is greater than the reference current, and delays the timing of the second vertical start signal by the predetermined time interval when the second current is smaller than the reference current.

11. The driving circuit of claim 10, wherein the predetermined time interval is equal to a time interval of a high period of the first gate signal.

12. The driving circuit of claim 9, wherein the signal generator further comprises a black data ratio calculator replaces the black data ratio of the previous frame based on the second vertical start signal from the second vertical start signal generator and provides the replaced black data ratio to the second current calculator.

13. The driving circuit of claim 9, wherein the start signal generator comprises:

a gamma converter that converts a gamma of the data signal;

a current calculator that calculates the current using a data signal corresponding to one frame of the converted data signal;

a black data ratio table that outputs a black data ratio corresponding to the current; and a second vertical start signal generator that decides a generation timing of the second vertical start signal based on the black data ratio.

14. The driving circuit of claim 9, wherein the gate driver comprises:

a first shift register that starts its operation in response to the first vertical start signal and sequentially outputs the first gate signal during a first period of a first gate control signal; and a second shift register that starts its operation in response to the second vertical start signal and sequentially outputs the second gate signal during a second period of a second gate control signal having a phase delayed by a second time interval more than the first gate control signal.

15. The driving circuit of claim 14, wherein the first period of the first gate control signal and the second period of the second gate control signal are in a low period, and the low period of the second gate control signal is included in a high period of the first gate control signal.

16. A display device comprising:

a timing controller that generates a first vertical start signal and outputs a data signal;

a start signal generator that calculates a current to display an image corresponding to one frame based on the data signal and generates a second vertical start signal delayed by a first time interval from the first vertical start signal, wherein the first time interval is determined based on the calculated current;

a gate driver that sequentially outputs a first gate signal in response to the first vertical start signal and sequentially outputs a second gate signal in response to the second vertical start signal;

a data driver that converts the data signal into a display data voltage to output the display data voltage during a high period of the first gate signal and outputs a black data voltage during a high period of the second gate signal; and a display part that receives the display data voltage and the black data voltage to display a display image and a black image, wherein the signal generator comprises:

a gamma converter that converts a gamma of the data signal;

a first current calculator that calculates a first current using a data signal corresponding to a present frame of the converted data signal;

a second current calculator that calculates a second current based on the first current and a black data ratio of a previous frame; and a second vertical start signal generator that compares the second current and a predetermined reference current to decide a generation timing of the second vertical start signal.

17. The display device of claim 16, wherein the signal generator comprises:

a gamma converter that converts a gamma of the data signal;

a current calculator that calculates a first current using a data signal corresponding to one frame of the converted data signal;

a black data ratio table that outputs a black data ratio corresponding to the current; and a second vertical start signal generator that decides a generation timing of the second vertical start signal based on the black data ratio.

* * * * *